US006468118B1

(12) United States Patent
Chen

(10) Patent No.: US 6,468,118 B1
(45) Date of Patent: Oct. 22, 2002

(54) PERSONAL WATERCRAFT

(75) Inventor: Shane Chen, Camas, WA (US)

(73) Assignee: CID, Inc., Vancouver, WA (US)

( * ) Notice: Subject to any disclaimer, the term of this patent is extended or adjusted under 35 U.S.C. 154(b) by 0 days.

(21) Appl. No.: 09/710,670

(22) Filed: Nov. 8, 2000

(51) Int. Cl.[7] ..... B63H 16/00

(52) U.S. Cl. ..... 440/21; 440/13; 114/61.1

(58) Field of Search ..... 441/76, 77; 114/274, 114/61.1; 440/13, 17, 19, 20, 21, 23, 25, 32

(56) References Cited

U.S. PATENT DOCUMENTS

| | | | | | |
|---|---|---|---|---|---|
| 1,006,118 | A | * | 10/1911 | Napier | 440/19 |
| 2,689,542 | A | * | 9/1954 | Daniels | 440/17 |
| 2,990,805 | A | | 7/1961 | Jacus | |
| 3,479,674 | A | * | 11/1969 | Beymer | 441/77 |
| 3,833,956 | A | * | 9/1974 | Meehan | 441/76 |
| 4,172,427 | A | | 10/1979 | Kindred | |
| 4,349,340 | A | | 9/1982 | Hoffmann | |
| 4,496,325 | A | | 1/1985 | Tweg | |
| 4,936,802 | A | * | 6/1990 | Ueno | 440/21 |
| 4,968,274 | A | | 11/1990 | Gregory | |
| 5,090,928 | A | | 2/1992 | Rybczyk | |
| 5,368,507 | A | | 11/1994 | Harris | |
| 6,033,276 | A | | 3/2000 | Han | |

OTHER PUBLICATIONS

Photograph of Watercraft sold at least prior to Nov. 8, 1999.
Photograph of "Pogofoil" Watercraft publically used at least prior to Nov. 8, 1999.

* cited by examiner

*Primary Examiner*—Stephen Avila
(74) *Attorney, Agent, or Firm*—Chernoff, Vilhauer, McClung & Stenzel, LLP

(57) ABSTRACT

A personal watercraft that includes at least one stepper. Each stepper is pivotally associated with a propulsion member that is moveable in a generally vertical direction so that the propulsion member is in a first position during downward motion of the stepper and a second position during upward motion of the stepper.

12 Claims, 7 Drawing Sheets

PERSONAL WATERCRAFT

BACKGROUND OF THE INVENTION

The present invention relates to watercraft, and in particular to a personal watercraft that is powered solely by its occupants.

A variety of personal watercraft exist that allow individuals to propel themselves across the surface of a body of water. Traditionally, personal watercraft were designed to move as a person sits reclined or lies prone and turns pedals with the hands and/or feet. These pedals are connected to a propeller by any one of a number of standard mechanical transmission systems. The propellers would typically spin below the surface of the water, though occasionally a watercraft would have a propeller that spins above and behind the craft, providing forward thrust by pushing air.

The primary drawback of these vehicles has always been the relatively low speed at which they may operate in comparison to motorized watercraft. This limitation results from the fact that fluid resistance to the watercraft's motion increases proportionally with respect to the square of the speed, and the capability of a human occupant to provide the power necessary to overcome that resistance is severely limited.

Initial efforts to overcome speed limitations sought to improve the efficiency of the power transmission system by which the energy expended by the occupant propelled water. In this vein, complex pulley and gear schemes were developed, as exemplified by Rybczyk, U.S. Pat. No. 5,090,928 and Harris, U.S. Pat. No. 5,368,507. In some instances, as seen by Kindred, U.S. Pat. No. 4,172,427 and Han, U.S. Pat. No. 6,033,276, fins were substituted for propellers in order to simulate the movement of fish through water. Regardless, such designs were always constrained by the limited power available from a human occupant.

An alternate approach sought to reduce the resistance, or drag, that the surrounding water imparted to the craft. In this regard, a number of lightweight personal watercraft were designed with improved hydrodynamic characteristics. One such design, exemplified by Hoffman, U.S. Pat. No. 4,349,340, mounted hydrofoils to the body of the watercraft so that the craft's hull was raised from the water when it reached a certain speed. Once raised from the water, the only drag force imparted to the craft resulted from the foils. Unfortunately, even this design is limited in that the weight of the occupant bears down on the watercraft, which must be raised above the surface of the water, impeding forward motion. More importantly, this watercraft requires a substantial expenditure of energy which can only be achieved by an occupant for a short period of time.

What is desired, then, is a personal watercraft that addresses the aforementioned shortcomings by providing an efficient propulsion mechanism to transfer the occupant's expended energy into forward motion, by reducing the drag that water imparts to the watercraft, and by minimizing the occupant's weight that bears on the watercraft.

BRIEF SUMMARY OF THE INVENTION

The present invention addresses the aforementioned shortcomings by providing a watercraft that includes at least one stepper. Each stepper is pivotally associated with a propulsion member that is moveable in a generally vertical direction so that the propulsion member is in a first position during downward motion of the stepper and a second position during upward motion of the stepper.

In one aspect, the invention provides for at least one floatation member and at least one stepper. Each stepper is pivotally associated with a propulsion member moveable in a generally vertical direction so that the propulsion member is in a first position during downward motion of the stepper and a second position during upward motion of the stepper.

Another aspect of the invention provides for at least one floatation member and at least one moveable member operable by a person. This moveable member operates at least one propulsion member suitable to cause the watercraft to move in a first direction where said person is substantially supported by the propulsion member and is substantially free from being supported by the floatation member.

The foregoing and other objectives, features, and advantages of the invention will be more readily understood upon consideration of the following detailed description of the preferred embodiment of the invention, taken in conjunction with the accompanying drawings.

DETAILED DESCRIPTION OF THE PREFERRED EMBODIMENT

Figure 1:
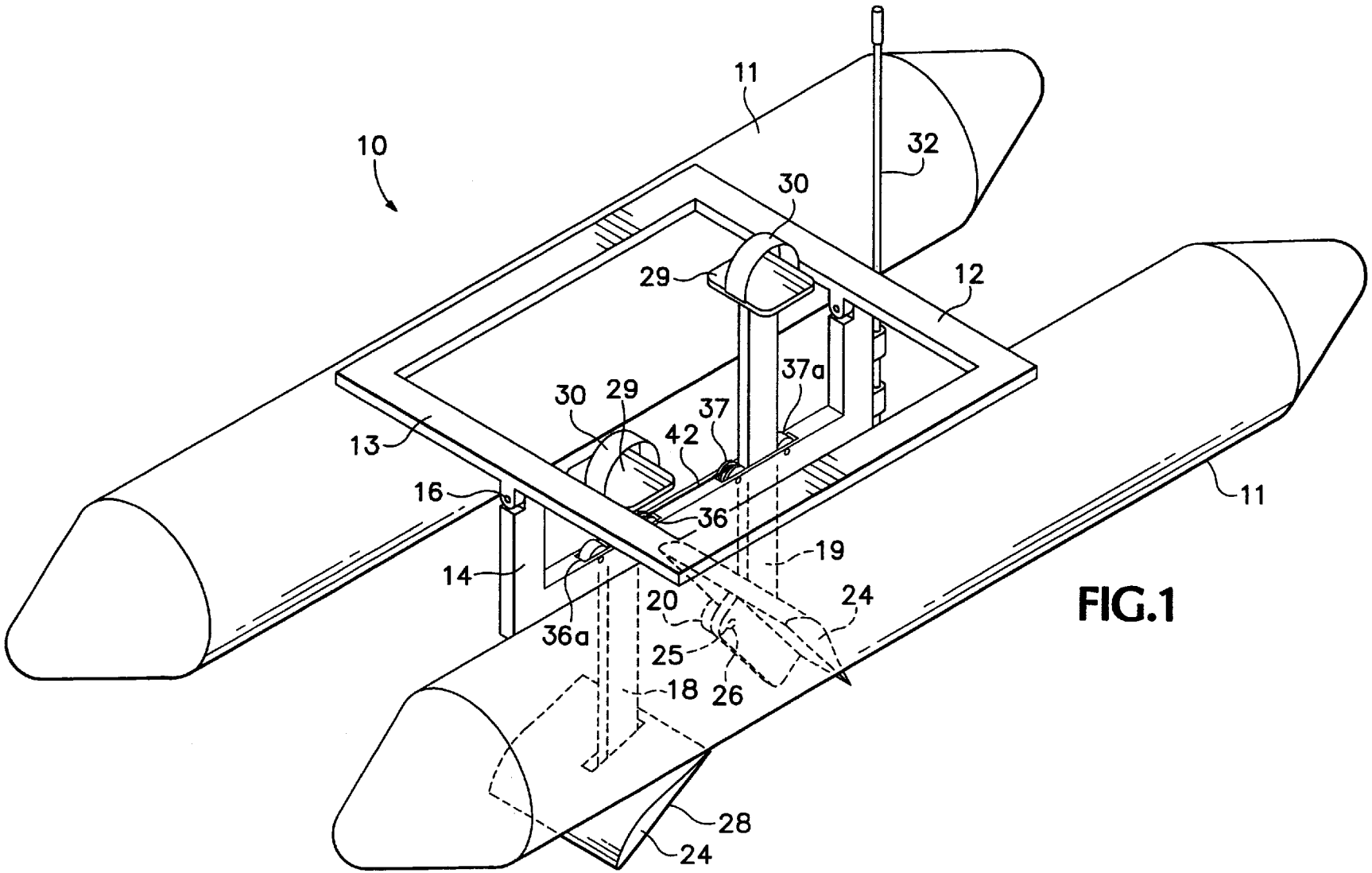
FIG. 1 is a perspective view of one preferred embodiment of the invention.

Referring to the figures, wherein like numerals refer to like elements, FIG. 1 shows a personal watercraft 10 having two steppers 18 and 19 moveable in a generally vertical direction. A propulsion member 24 is pivotally attached to each stepper so that as each stepper is moved by the occupant in a downwardly vertical direction, the propulsion member 24 pushes the water beneath the watercraft in a generally backward and downward direction, moving the watercraft forward and supporting the occupant's weight. Because at least some of the weight of the occupant is supported by the stepper and hence the propulsion member rather than the floatation member, the floatation member rides high in the water. The watercraft thus substantially reduces the amount of drag imposed by the floatation members, allowing the watercraft to obtain high speeds for sustained amounts of time.

In one preferred embodiment, the propulsion member 24 is preferably a hydrofoil so that the drag caused by forward motion through water is further minimized and so that the propulsion member creates lift. Other embodiments of the invention, however, may use propulsion members other than hydrofoils.

To facilitate operation of the watercraft, one preferred embodiment includes a metallic frame 12 that is attached to a pair of floatation members 11. This allows the occupant to obtain balance from the floatation members 11 that move with the occupant who is self-propelled through the water. The steppers 18 and 19 are preferably connected or supported by any attached frame in a manner that minimizes friction between the steppers and the frame.

The watercraft provides an efficient propulsion mechanism, directly transferring the occupant's expended energy into forward motion by propelling the water beneath the craft in a backward direction. Further, the propulsion system also supports the weight of the occupant because the foil 24 pushes water downward as well as backward. The watercraft therefore dramatically reduces the drag that would result had only the floatation members fully supported the weight of the occupant.

Figure 2:
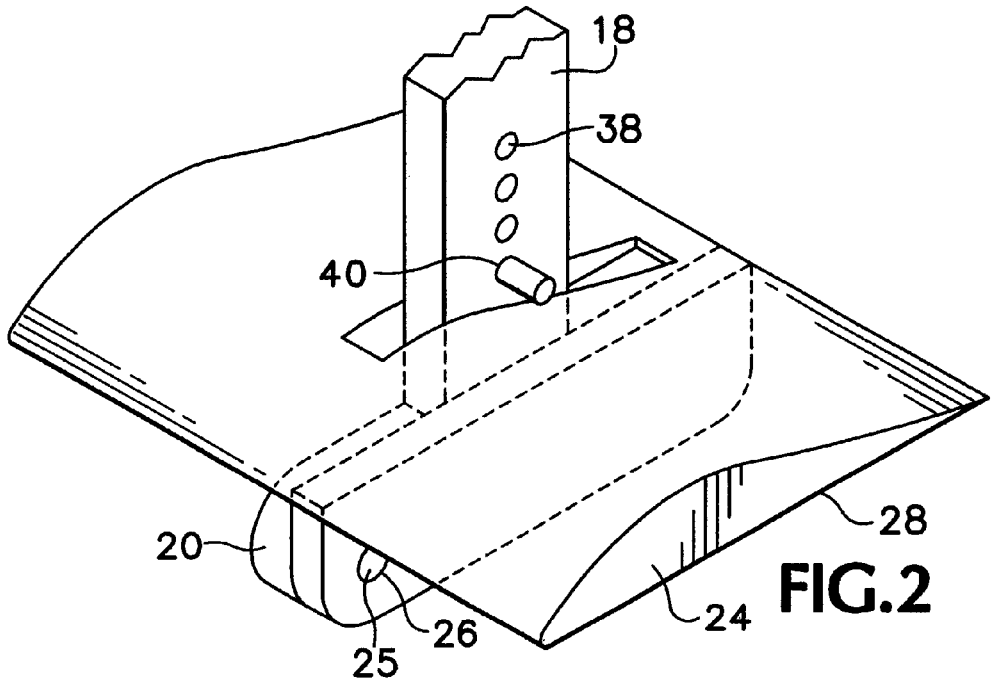
FIG. 2 is a cutaway perspective view of the bottom section of the steppers used in the preferred embodiment depicted in FIG. 1, showing an attached foil.
Figure 2A:
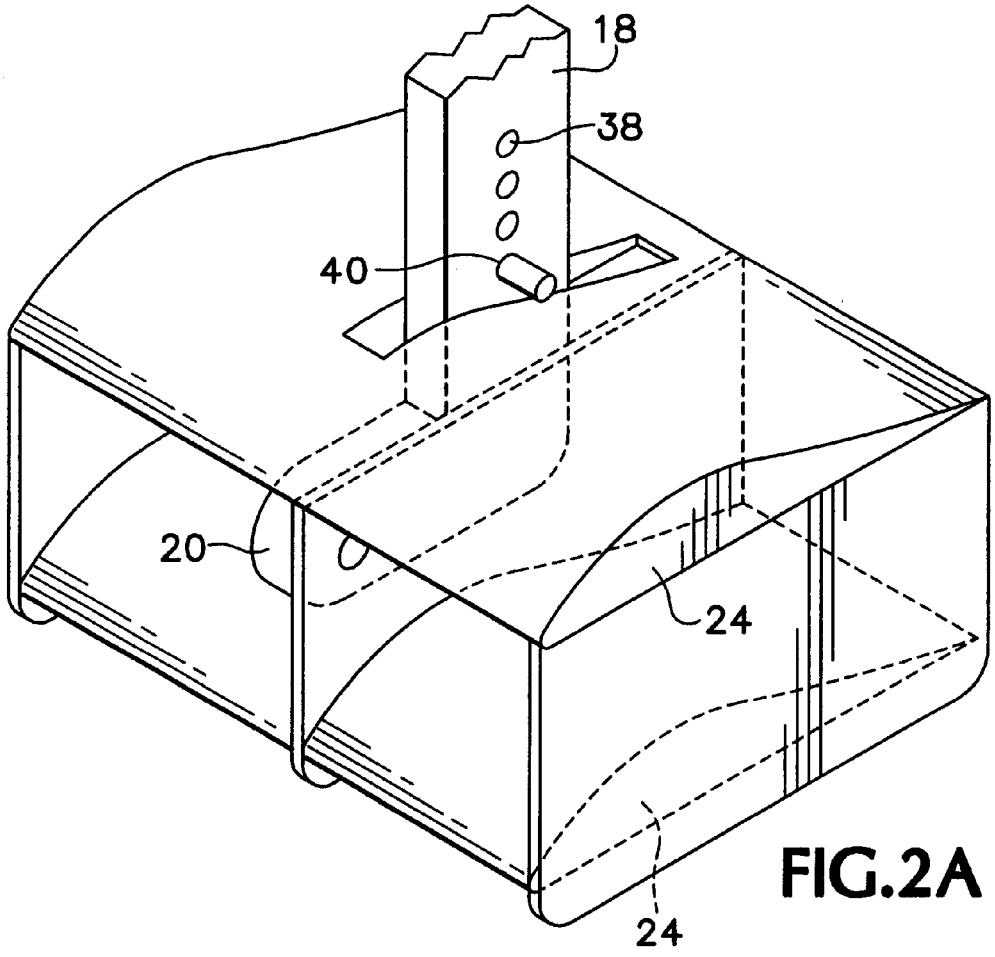
FIG. 2A is a cutaway perspective view like that of FIG. 2 but showing an alternative bottom section of a stepper having a pair of vertically spaced apart foils.

Referring particularly to FIG. 2, the preferred embodiment has a stepper with a lower boot portion 20. The propulsion member 24 is pivotally attached by means of a pin 25 to each lower boot portion 20 at an off-centered pivot point 26 on the propulsion member 24. In this manner, as each stepper moves in a vertical direction through a fluid, the propulsion member 24 pivots about the pivot point.

FIG. 2 also shows the lower boot portion 20 having a graduated series of holes 38 into which a stop 40 may be selectively placed. By choosing the placement of the stop 40, the occupant may vary the maximum angle of inclination through which the foil 24 may pivot and hence set the amount of thrust achieved on each downstroke. (As used herein, the angle of inclination refers to the angle of the lower flat surface 28 of the propulsion member relative to the horizontal surface of the water.) As seen in FIGS. 1 and 2, pivotal movement of the foil 24 on the upstroke is unconstrained in this particular embodiment so that the propulsion member 24 may fully pivot (even to a roughly vertical position), allowing the steppers 18 and 19 to be easily raised through the water. Other embodiments may set a maximum angle of inclination on the upstroke as well as the downstroke. Thus, as the stepper is pushed downwardly into the water, the propulsion member is in a first position such that the watercraft is pushed forward and support is provided to the occupant. When the stepper reaches the end of the downward stroke, the stepper is pulled upward, and the propulsion member pivots to a second position having an angle of inclination that facilitates upward movement of the stepper.

Figure 5:
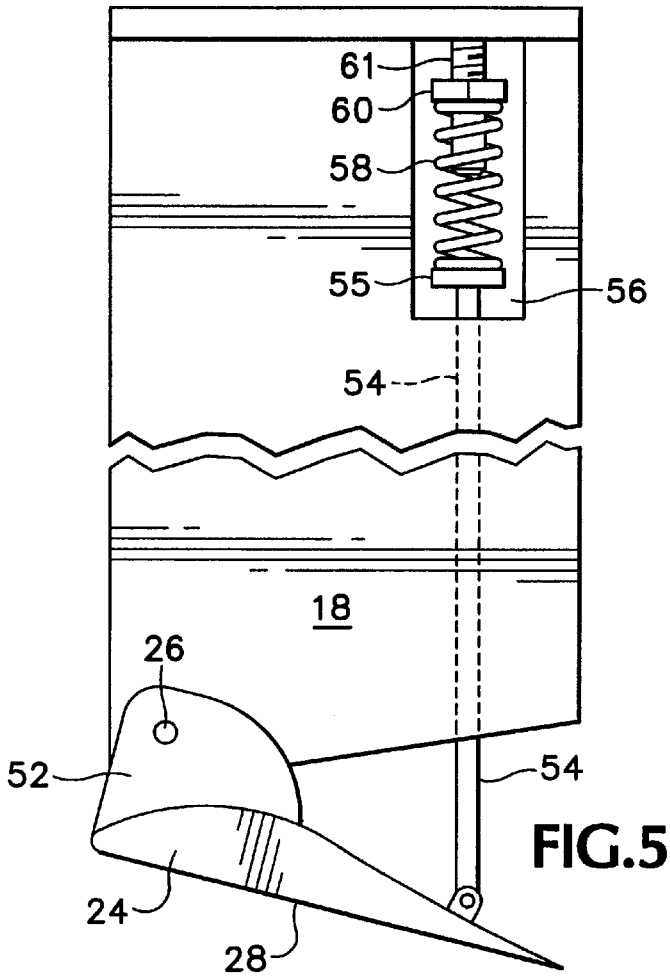
FIG. 5 is a side view of a stepper having an attached propulsion member and an internal spring mechanism to control the angle of inclination of the propulsion member.

The angle of inclination may be controlled through a variety of other designs. FIG. 5 depicts one such alternate design. In this configuration, stepper 18 is pivotally attached to propulsion member 24 by a hinge 52. Stepper 18 defines a vertical bore 56 extending the length of the stepper, within which a rod 54 is housed. The rod 54 is connected at its lower end to the upper surface of propulsion member 24 and is capable of controlling the angle of inclination of the propulsion member as it moves vertically. Movement of the rod 54 is controlled by a spring 58 mounted within the bore 56. The spring is compressed between an upper end of the rod 55 and an adjustable disk 60. The disk 60 is threadably engaged with a threaded bolt 61 that is attached to the upper portion of the stepper. Positioning the disk 60 determines the inclination of the propulsion member.

During operation of the watercraft, spring 58 automatically adjusts the inclination of the propulsion member 24 for better performance. The angle of inclination of propulsion member 24 determines the relative proportion of lift to thrust on the downstroke. As more power is provided on the downstroke, spring 58 is compressed, allowing a steeper angle of inclination, and thus directing the increased power primarily to the thrust component. Conversely, if power on the downstroke diminishes, the spring 58 adjusts the angle of inclination to ensure that enough lift is provided to support the weight of the occupant. The spring also allows the propulsion member to pivot smoothly from the downward stroke to the upward stroke. The spring 58 stores and releases energy provided to the stepper, thus automatically adjusting the angle of inclination to be at an optimum angle.

As seen in FIG. 5, the adjustable disk 60 may be positioned vertically along the threaded bolt to determine the angle of inclination when the spring 58 is relaxed. This flexibility allows the occupant to tailor the hydrodynamics of the watercraft to his or her weight. Further, the adjustable disk 60 may be set so that the spring 58 forces the propulsion member 24 into a better angle of attack for the upstroke once the downstroke is completed, and before the occupant begins to pull up on the stepper. For example, the disk 60 may be adjusted so that the position of the propulsion member 24 is as shown in FIG. 5 when the spring 58 is uncompressed, i.e., at equilibrium. If the equilibrium angle of inclination of the propulsion member is set in this fashion, forward motion of the watercraft will cause the stepper to move upward without any effort by the occupant.

Alternatively, the angle of inclination of the propulsion member 24 may be controlled by interconnecting a spring between the stepper 18 and the propulsion member 24. For example, a spring may be connected around the pivot point 26 to both the boot 20 and the propulsion member 24, or could be connected between the lower rear portion 22 of the boot 20 and the propulsion member 24.

Figure 4:
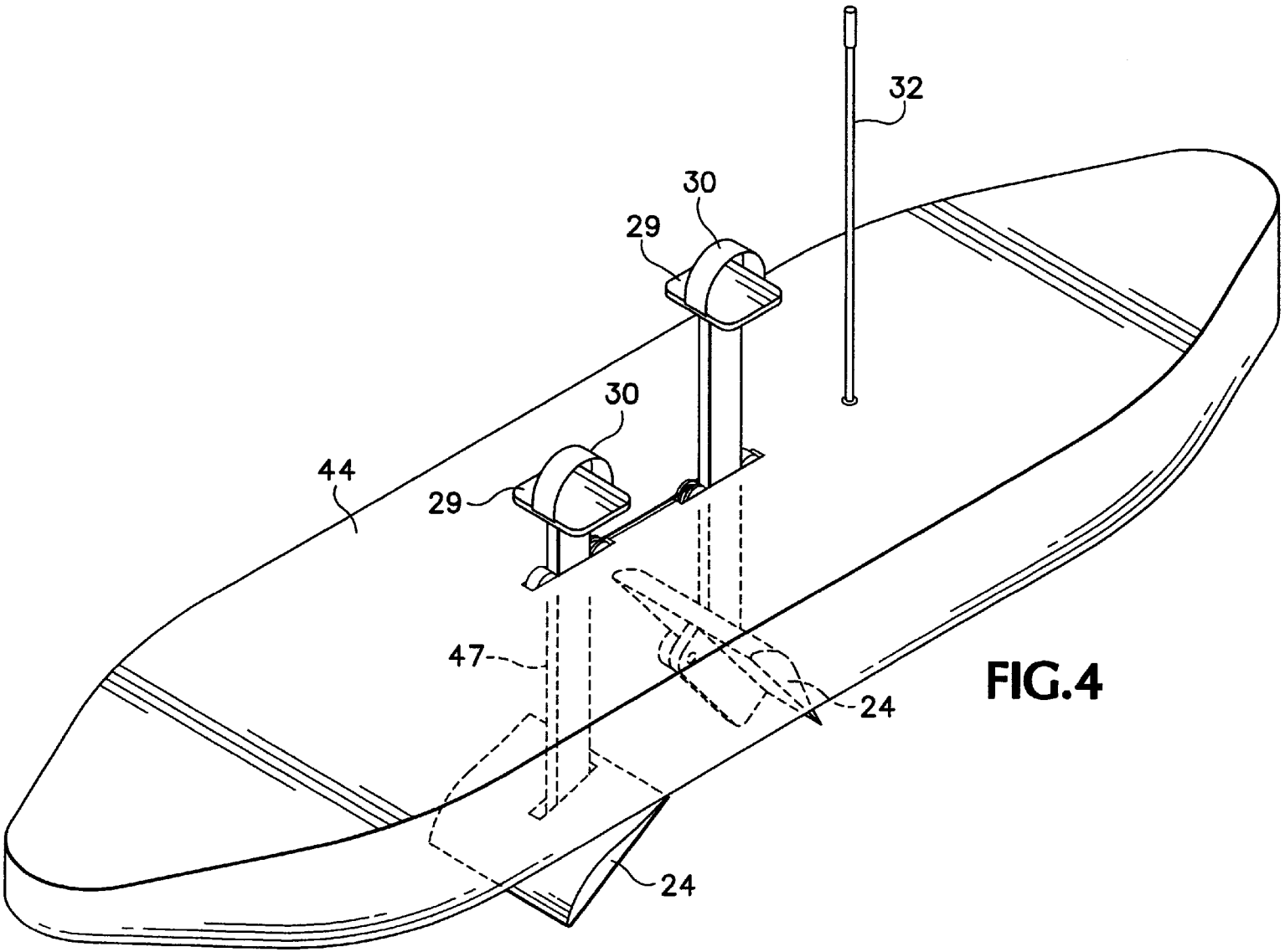
FIG. 4 is a perspective view of another embodiment of the invention showing a single floatation member.

In one embodiment, the watercraft substantially reduces drag by decoupling the weight of the occupant from the frame 12. Referring now to FIG. 4, one such embodiment may include four pairs of pulley-shaped bearings 36, 36*a*, 37, and 37*a*, housed within frame 12 and aligned on either side of each stepper 18 and 19. These pulley shaped bearings reduce friction between the frame 12 and the steppers 18. By minimizing friction between the steppers 18 and the frame 12, the portion of the occupant's weight that is supported by the metallic frame 12 and the floatation members 11 is reduced. This, in turn, reduces the drag imparted to the watercraft. Because the amount of weight transferred to the floatation members is reduced, the floatation members ride higher in the water, thus lowering resistance to movement and decreasing drag.

Figure 3:
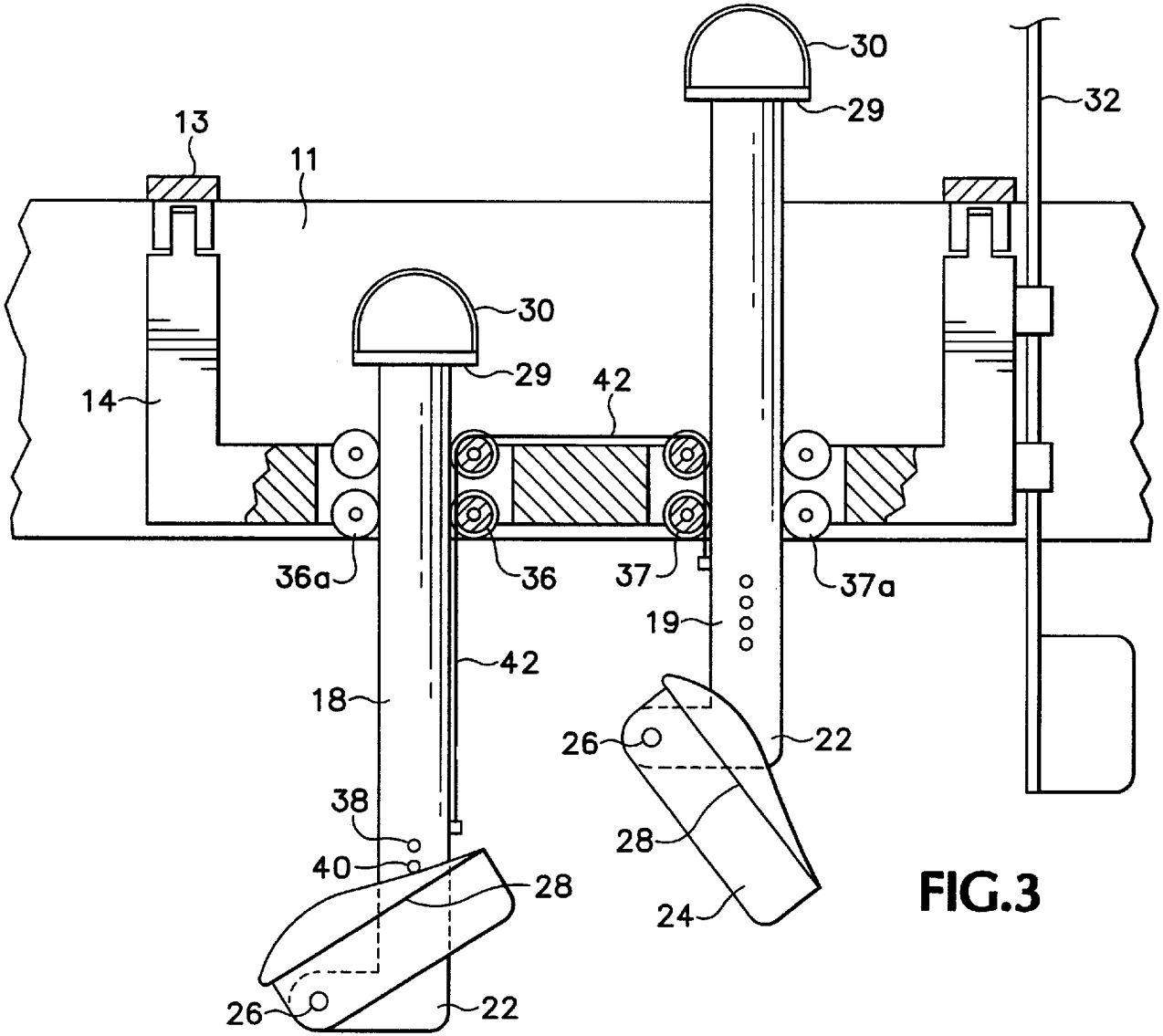
FIG. 3 is a partial sectional view of the preferred embodiment depicted in FIG. 1, taken through the center of the frame.

The steppers 18 and 19 may be optionally interconnected so as to move up and down in a coordinated fashion. FIG. 3 shows a strap 42 interconnecting stepper 18 with stepper 19 through the intervening pairs of pulley-shaped bearings 36 and 37. In this fashion, the occupant need only shift weight between stepper 18 and stepper 19 to propel the watercraft. Movement of the steppers 18 and 19 may be coordinated through other constructs, such as by connecting the steppers by a rigid beam that pivots about a central point between the two.

Figure 6:
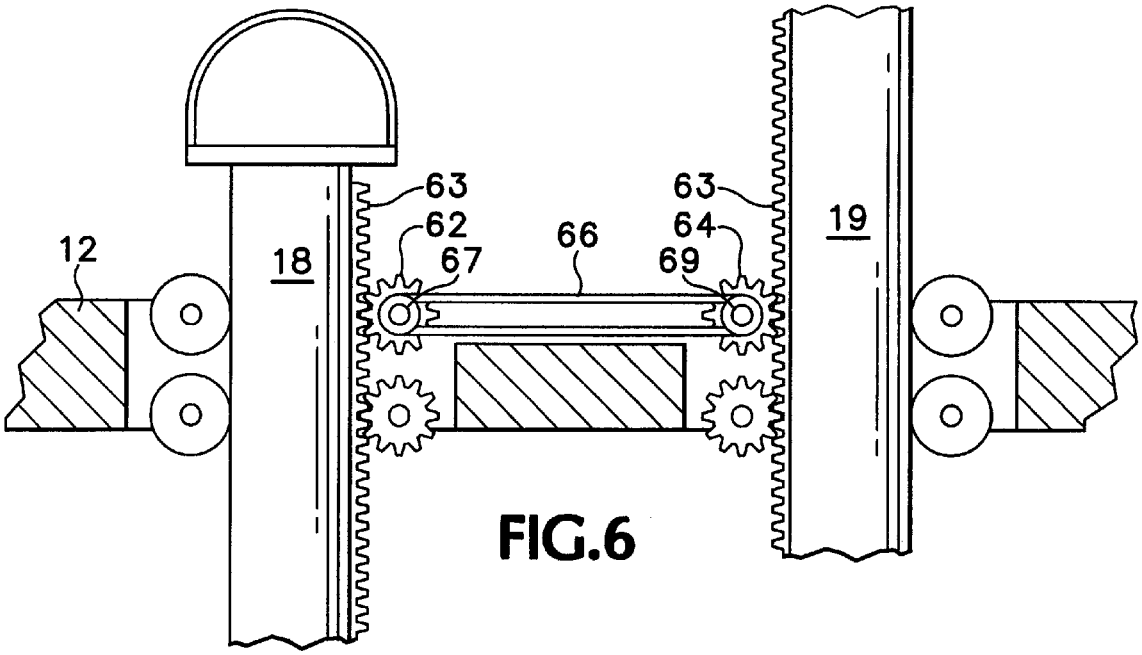
FIG. 6 is a cross-sectional view of a part of an alternate embodiment of the present invention showing a watercraft having two steppers coordinated by a gear and chain system.

Alternatively, the movement of steppers 18 and 19 may be coordinated by a gear and chain system depicted in FIG. 6. FIG. 6 shows two steppers, 18 and 19, slidably engaged within frame 12. Each stepper has a tooth portion 63 that engages with gears 62 and 64, each positioned on the interior side of each stepper 18 and 19, respectively. Gears 62 and 64 each have an interior geared portion 67 and 69, around which a chain 66 is positioned. In this fashion, downward motion of one stepper forces upward motion of the other stepper.

However, unlike the embodiment of FIG. 3, in the embodiment shown in FIG. 6 the weight of the occupant is transferred to the frame 12 through the gears 62, 64 and 67, 69. The lift provided by the propulsion member 24, though, is also transferred to the frame 12. Thus, as the watercraft begins moving forward, the foils of the propulsion member 24 will provide lift to the frame, and hence to the entire watercraft 10, including the occupant. This has the advantage of allowing the addition of a seat to the frame of the watercraft to support the weight of the occupant.

The watercraft may also include a rudder 32 by which the occupant may navigate through the water. For example, FIG. 1 shows a metal frame 12 having an upper portion 13 to which a rudder 32 as well as any desired floatation device 11 are attached. The metal frame 12 also has a lower portion 14 through which the steppers 18 and 19 are slideably engaged. The upper portion 13 and the lower portion 14 of the metallic frame 12 are connected by a hinge 16 that allows relative rotation between the two. In this manner, when the occupant alters direction by adjusting the rudder 32, the occupant and the lower portion 14 may lean in the direction of the turn while any floatation members attached to the watercraft will stay level with the surface of the water.

Many alternative types of floatation members and propulsion members may be used with the present invention. FIG. 4, for example, shows an embodiment of the invention having a single floatation member 44 through which the steppers 47 and 48 slide.

The invention may also include any of a number of enhancements. As examples, the steppers 18 and 19 may include a flattened pedal 29 with a strap 30 to secure the occupant's feet during operation of the watercraft. Rigid members may be attached to any included frame to serve as handles for the occupant.

Figure 7:
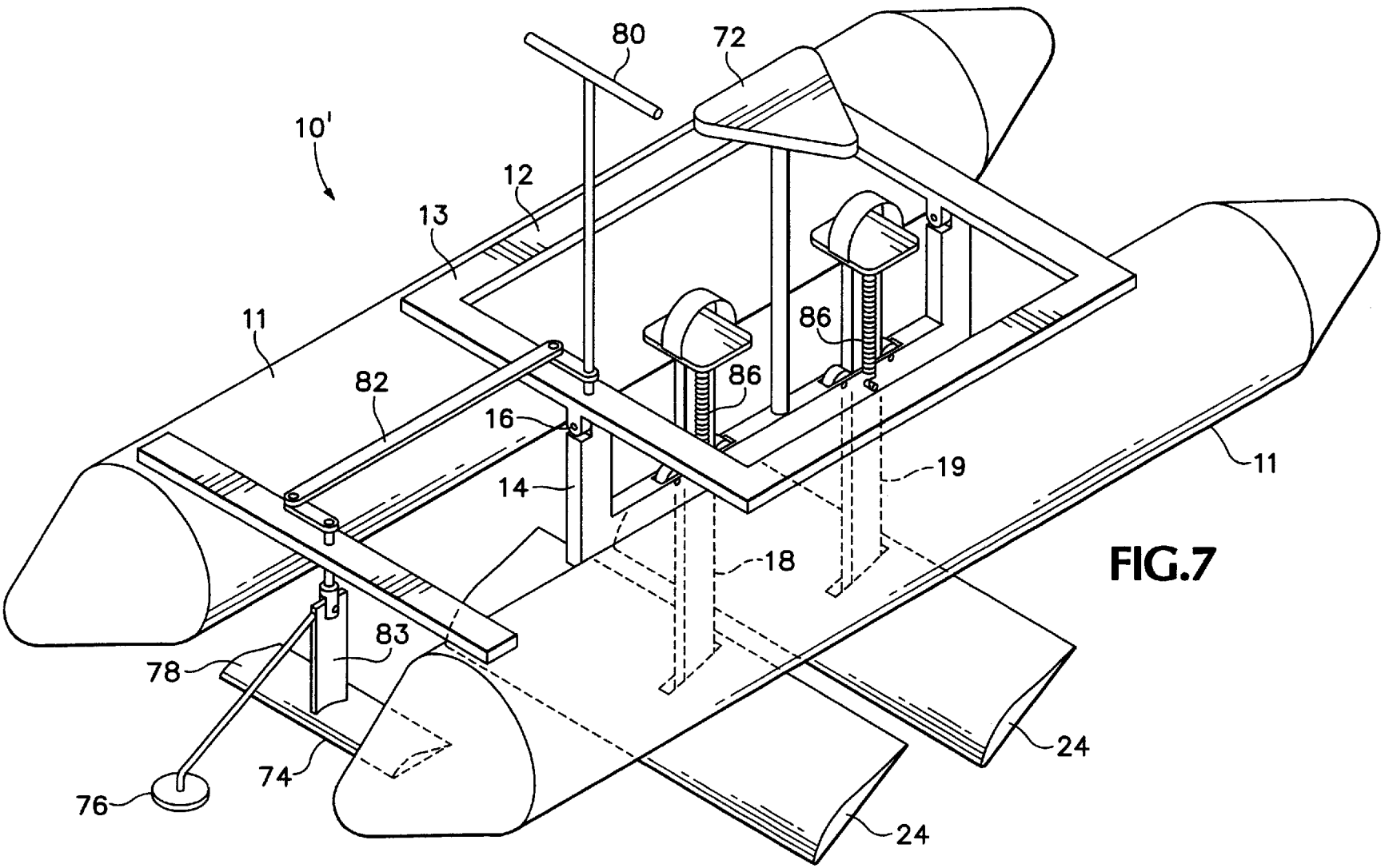
FIG. 7 is a perspective view of an alternate embodiment of the invention.

FIG. 7 shows yet another embodiment 10' of the invention. FIG. 7 provides the floatation members, frame, steppers and propulsion members as described above for the other embodiments. However, the watercraft of FIG. 7 couples the steppers 18 and 19 to the frame 12 so that the propulsion members 24 may provide lift to the frame. In FIG. 7, this is accomplished by interconnecting a tension spring 86 between the frame and the top of the stepper. The tension spring is mounted to the frame and the stepper such that the spring provides increasing resistance as the stepper is pulled upward away from the frame, and decreasing resistance as the stepper is pushed down. In this manner, as the foil provides lift to the stepper, the spring provides an upward force on the frame and thereby supports the frame as the watercraft moves forward. By providing lift to the frame, the springs allow for the addition of a seat 72 to the frame.

FIG. 7 also shows an optional canard 74 of well-known design that may be attached to the forward end of the watercraft. The canard 74 comprises a water sensor 76 that pivotally controls the angle of attack of a foil 78. The canard acts to fix the vertical position of the forward end of the watercraft with respect to the surface of the water. When the forward end of the watercraft dips into the water, the water sensor 76 adjusts the foil 78 to provide more lift. Conversely, if the forward end rises too high, the water sensor 76 adjusts the foil 78 to decrease lift. In this fashion, the forward end of the watercraft may be held at a fixed position above the surface of the water. Finally, FIG. 7 depicts a steering member 80 supported by the frame 13 and connected to the canard 74 through a rod 82. The canard includes a blade 83 which turns in response to turning the steering member 80. The occupant may therefore steer the watercraft by turning the blade 83 as it moves through the water.

Figure 8:
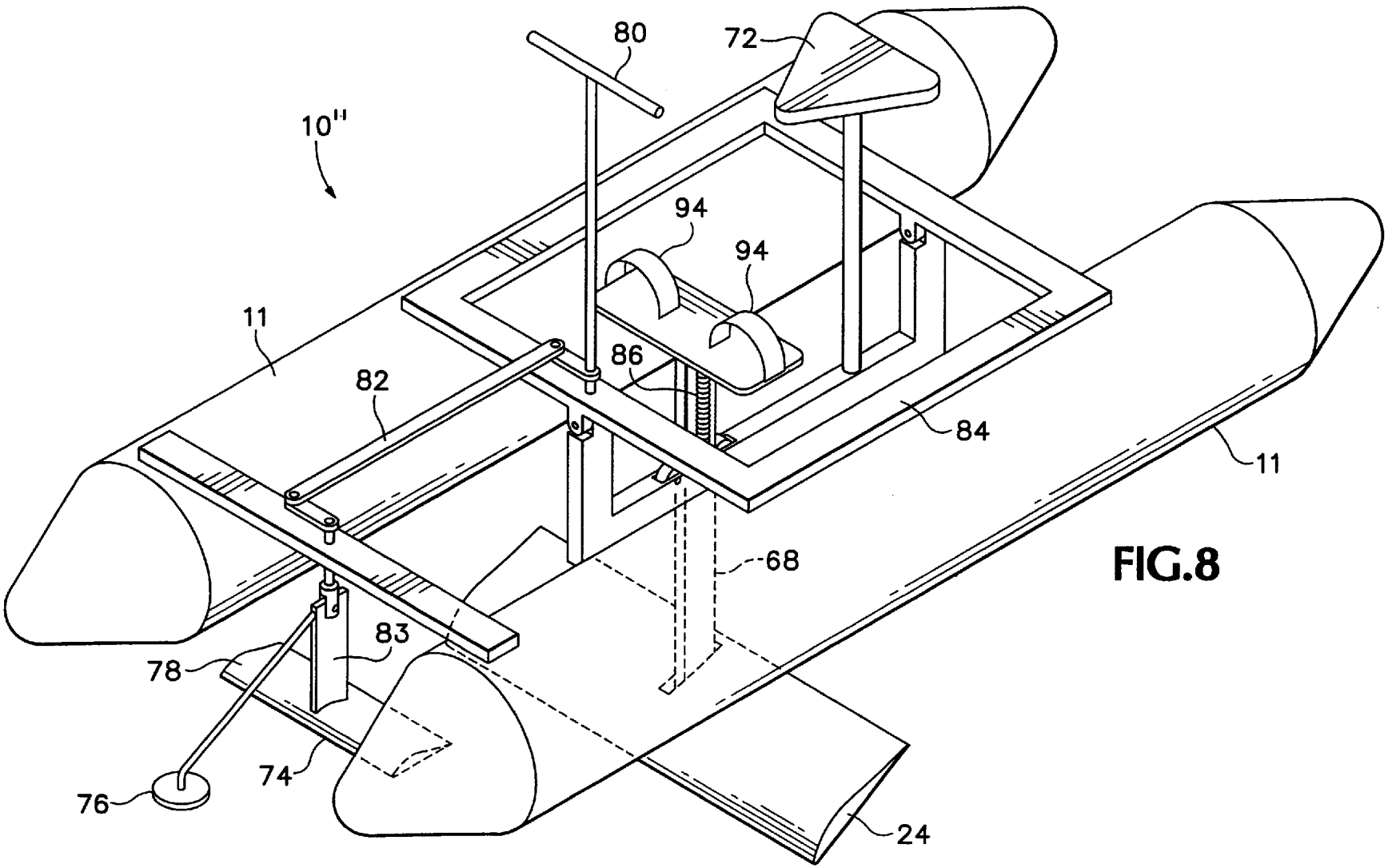
FIG. 8 is a perspective view of a second alternate embodiment of the invention.

FIG. 8 depicts an alternate design 10" for a watercraft that includes a single stepper 68 pivotally attached to a propulsion member 70. A seat 72 is mounted to frame 84 and a tension spring 86 connects the top portion of stepper 68 to the frame 84. Like the embodiment of FIG. 7, the tension spring 86 is mounted to the frame and stepper such that it provides increasing resistance as stepper 68 is pulled upwards away from the frame by the occupant and decreasing resistance as stepper 68 is pushed down by the occupant. In this manner, as the foil provides lift to the stepper, spring 68 provides an upward force on frame 84 and thereby supports the frame as the watercraft moves forward, allowing the occupant to be seated and supported by the frame. At sufficient speed, the spring may lift the frame and thus the watercraft out of the water. In this particular embodiment, the stepper requires a footstrap 94 so that the occupant may pull the stepper in an upward direction.

While all of the above embodiments have been described as personal watercraft powered by one or more occupants, nonetheless it may be possible to add a motor to provide for mechanical propulsion of the watercraft. For those embodiments in which the steppers are coupled to the frame such that the propulsion members are capable of providing lift to the frame, a motor may be added which is supported by the frame. That is, for any of the above-described embodiments which include a seat to support the weight of the occupant, an alternative embodiment may include the addition of a motor as well.

The terms and expressions employed in the foregoing specification are used therein as terms of description and not of limitation, and there is no intention in the use of such terms and expressions of excluding equivalents of the features shown and described or portions thereof, it being recognized that the scope of the invention is defined and limited only by the claims that follow.

What is claimed is:

1. A watercraft comprising:

(a) at least one floatation member; and (b) at least one stepper pivotally associated with a hydrofoil moveable in a generally vertical direction so that said hydrofoil pivots from a first position during downward motion of said hydrofoil to a second position during upward motion of said hydrofoil; and (c) a canard located at a forward end of said watercraft.

2. The watercraft of claim 1 including a seat.

3. The watercraft of claim 1 including a pair of floatation members and a frame, said frame interconnecting said pair of floatation members and supporting a seat.

4. A watercraft comprising:

(a) at least one floatation member; and (b) at least one foot-operable stepper pivotally associated with a hydrofoil having a flat bottom surface and a curved upper surface, said hydrofoil moveable in a generally vertical direction so that said hydrofoil pivots from a first position during downward motion of said hydrofoil to a second position during upward motion of said hydrofoil, and wherein said at least one foot-operable stepper is operated by a person standing on said at least one foot-operable stepper.

5. The watercraft of claim 4 further comprising a plurality of foot-operable steppers.

6. The watercraft of claim 5 where said foot-operable steppers are moveable independently of each other.

7. The watercraft of claim 5 where said foot-operable steppers are interconnected so that downward motion of one stepper causes upward motion of another stepper.

8. The watercraft of claim 4 where said hydrofoil is pivotally attached to said foot-operable stepper at a point spaced apart from the axis of moment of said hydrofoil.

9. The watercraft of claim 4 having a stop associated with each said hydrofoil that defines an angle between said propulsion member and said generally vertical direction during downward motion of said stopper.

10. The watercraft of claim 4 wherein said foot-operable stepper includes a spring to control an angle of inclination of said propulsion member.

11. The watercraft of claim 4 wherein said at least one foot-operable stepper is elongate and has at an upper end a platform for supporting a user's foot and has a footstrap.

12. A watercraft comprising:

(a) at least one floatation member;

(b) a seat supported by said at least one floatation member;

(c) a hydrofoil capable of movement in a generally vertical direction with respect to said floatation member, said hydrofoil operatively interconnected with said floatation member so as to be capable of supporting said floatation member;

(d) a foot-operable moveable member connected with said hydrofoil, wherein movement of said foot-operable member moves said hydrofoil in said generally vertical direction between a first position and a second position; and (e) a canard connected to said floatation member at a forward end of said watercraft.

* * * * *